US009759156B2

(12) United States Patent
Perrone et al.

(10) Patent No.: US 9,759,156 B2
(45) Date of Patent: Sep. 12, 2017

(54) ASYMMETRIC PISTON

(71) Applicant: Mahle International GmbH, Stuttgart (DE)

(72) Inventors: Luiz Perrone, Ann Arbor, MI (US); Kenneth L. Wirkkala, II, Novi, MI (US); Iosif Muscas, Troy, MI (US)

(73) Assignee: Mahle International GmbH (DE)

( * ) Notice: Subject to any disclaimer, the term of this patent is extended or adjusted under 35 U.S.C. 154(b) by 147 days.

(21) Appl. No.: 14/638,339

(22) Filed: Mar. 4, 2015

(65) Prior Publication Data

US 2016/0258382 A1 Sep. 8, 2016

(51) Int. Cl.

| | |
|---|---|
| ***F02F 3/00*** | (2006.01) |
| ***B21K 1/18*** | (2006.01) |
| ***F02F 3/20*** | (2006.01) |
| ***F02F 3/26*** | (2006.01) |
| ***F02F 3/02*** | (2006.01) |
| *F02F 3/22* | (2006.01) |

(52) U.S. Cl.

CPC ..... *F02F 3/003* (2013.01); *B21K 1/185* (2013.01); *F02F 3/0069* (2013.01); *F02F 3/025* (2013.01); *F02F 3/20* (2013.01); *F02F 3/26* (2013.01); *F02F 3/22* (2013.01); *F02F 2003/0007* (2013.01); *F02F 2003/0061* (2013.01)

(58) Field of Classification Search

CPC ..... F02F 3/003; F02F 3/20; F02F 3/26; F02F 3/0069; F02F 3/025; F02F 3/22; F02F 2003/0061; F02F 2003/0007; B21K 1/185

USPC ..... 123/193.6

See application file for complete search history.

(56) References Cited

U.S. PATENT DOCUMENTS

| | | | | |
|---|---|---|---|---|
| 2,067,278 | A * | 1/1937 | Nelson | F02F 3/02 92/210 |
| 2,142,272 | A * | 1/1939 | Jardine | F16J 1/04 92/233 |
| 5,000,078 | A * | 3/1991 | Gabele | F02F 3/022 123/193.6 |
| 5,054,375 | A * | 10/1991 | Kawabata | F02F 3/022 123/193.6 |
| 5,839,352 | A * | 11/1998 | Ribeiro | F02F 3/26 123/193.6 |
| 5,894,824 | A * | 4/1999 | Watanabe | F02F 3/022 123/193.6 |
| 6,026,777 | A | 2/2000 | Kemnitz et al. | |
| 6,073,602 | A * | 6/2000 | Muta | F02F 3/0076 123/193.6 |
| 6,862,976 | B2 | 3/2005 | Gaiser et al. | |
| 8,347,843 | B1 * | 1/2013 | Batiz-Vergara | F02F 3/025 123/193.4 |
| 8,689,743 | B2 * | 4/2014 | Scharp | F02F 3/22 123/193.6 |

(Continued)

*Primary Examiner* — Marguerite McMahon

(74) *Attorney, Agent, or Firm* — Fishman Stewart PLLC

(57) ABSTRACT

Exemplary pistons and methods of making the same are disclosed. An exemplary piston may include a crown defining a combustion bowl and a ring land extending circumferentially around the combustion bowl. Exemplary pistons may further include a skirt supporting the crown. The skirt may include a pair of pin bosses defining a pin bore configured to receive a piston pin, and two opposing skirt supports defining surfaces configured to slide along a cylinder bore surface. The skirt supports each define a different radial stiffness.

18 Claims, 5 Drawing Sheets

(56) References Cited

U.S. PATENT DOCUMENTS

| | | | | |
|---|---|---|---|---|
| 2011/0197845 | A1* | 8/2011 | Flowers | F02F 3/003<br>123/193.6 |
| 2012/0037112 | A1* | 2/2012 | Muscas | F02F 3/003<br>123/193.6 |

* cited by examiner

ASYMMETRIC PISTON

BACKGROUND

Internal combustion engine manufacturers are constantly seeking to increase power output and fuel efficiency of their products. One method of generally increasing efficiency and power is to reduce the oscillating mass of an engine, e.g., of the pistons, connecting rods, and other moving parts of the engine. Efforts to increase engine power and/or efficiency also may also result in an increase in pressure and/or temperature within the combustion chamber during operation.

Power in an engine is typically transferred from a piston reciprocating within a cylinder bore via a connecting rod linked to the piston by way of a piston pin received within a corresponding pin bore of the piston. Thus, as the air/fuel mixture expands within the combustion chamber, the piston is forced downward, pushing the connecting rod downward. The connecting rod is linked with a crankshaft, which is rotated as the piston reciprocates.

Pistons are typically provided with skirts or other cylindrical surfaces configured to slide along corresponding cylinder bore surfaces of an engine. The lateral movement of the lower or large end of the connecting rod results in the connecting rod being angled with respect to the piston/cylinder axis as the piston is forced downward by combustion pressure. Accordingly, one side of the piston, referred to as the "thrust side," typically experiences a greater load against the cylinder bore, compared with the opposite or "anti-thrust side" of the piston. This imbalance causes vibrations such as secondary motions, which tends to cause cavitation of cylinder bore surfaces.

Accordingly, there is a need for a piston that addresses the above problems.

BRIEF DESCRIPTION OF THE DRAWINGS

Referring now to the drawings, illustrative examples are shown in detail. Although the drawings represent the exemplary illustrations described herein, the drawings are not necessarily to scale and certain features may be exaggerated to better illustrate and explain an innovative aspect of an exemplary illustration. Further, the exemplary illustrations described herein are not intended to be exhaustive or otherwise limiting or restricting to the precise form and configuration shown in the drawings and disclosed in the following detailed description. Exemplary illustrations of the present invention are described in detail by referring to the drawings as follows.

DETAILED DESCRIPTION

Figure 1:
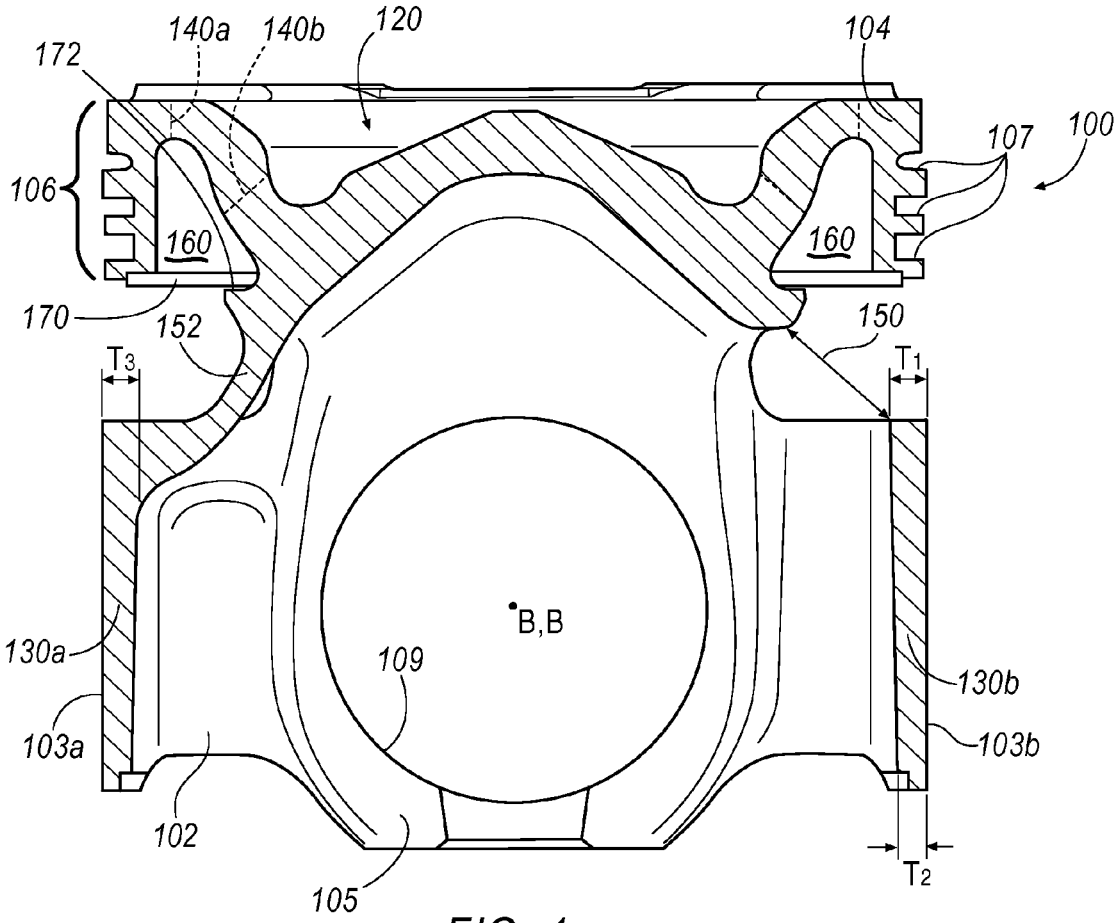
FIG. 1 is a sectional view of a piston, according to an exemplary illustration.

Reference in the specification to "an exemplary illustration", an "example" or similar language means that a particular feature, structure, or characteristic described in connection with the exemplary approach is included in at least one illustration. The appearances of the phrase "in an illustration" or similar type language in various places in the specification are not necessarily all referring to the same illustration or example.

Exemplary pistons are disclosed herein, which may include a crown defining a combustion bowl and a ring land extending circumferentially around the combustion bowl. Exemplary pistons may further include a skirt supporting the crown. The skirt may include a pair of pin bosses defining a pin bore configured to receive a piston pin, and two opposing skirt supports defining surfaces configured to slide along a cylinder bore surface. One of the skirt supports defines an opening such that the skirt supports each define a different radial stiffness.

Exemplary methods may include forming a crown defining a combustion bowl and a ring land extending circumferentially around the combustion bowl, and providing a skirt supporting the crown. The skirt may include a pair of pin bosses, each defining a pin bore configured to receive a piston pin. The skirt may further include two opposing skirt supports defining surfaces configured to slide along a cylinder bore surface. The method may further include establishing a first one of the skirt supports as defining an opening such that the skirt supports each define a different radial stiffness.

As noted above, skirt supports on opposing sides of the piston may define a different radial stiffness. Merely as one example, a thrust side of the piston (i.e., a side of the piston which receives a larger share of a load from the cylinder bore during reciprocation along the cylinder bore compared with the opposite side of the piston with respect to the piston pin) may have a greater stiffness than an anti-thrust side of the piston. As will be described further below, some exemplary pistons may have a different radial stiffness on opposing sides of the piston as a result of different structural characteristics of the skirts or structure thereof. For example, skirts on opposing sides of the piston may have different wall thicknesses, or other differences in structure connecting the skirt to the piston, thereby resulting in different radial stifihesses of the piston/skirt on either side. The asymmetric stiffness of exemplary pistons may even out lateral motion of the piston between the thrust side and anti-thrust side, thereby reducing noise/vibration/harshness associated with the piston. Moreover, a difference in radial stiffness between opposing skirt supports and/or sides of a piston may correspond to differences in radial loads experienced by each side of the piston during reciprocation within a cylinder bore. Merely as examples, in one exemplary approach a thrust side of the piston may have a radial stiffness that is approximately twice as great as a radial stiffness of the anti-thrust side of the piston. In another example, the skirt support on the thrust side of the piston may have a radial stiffness that is 2-3 times as large as that of the skirt support on the anti-thrust side.

Turning now to FIG. 1, an exemplary piston 100 is illustrated. Piston 100 may include a piston skirt 102 and a crown 104. In some examples, the piston 100 may be formed in a single piece, e.g., by forging or casting. In other examples, as will be further described below, the crown 104 and skirt 102 may be initially formed as separate components and then joined together, e.g., by welding or bonding.

The skirt 102 and/or crown 104 may define a combustion bowl 120. The crown 104 may include a ring belt portion 106 that is configured to seal against an engine bore (not shown) receiving the piston 100. For example, the ring belt portion 106 may define one or more circumferential grooves 107 that receive piston rings (not shown), which in turn seal against engine bore surfaces during reciprocal motion of the piston 100 within the engine bore.

The skirt 102 may include opposing skirt supports 130*a*, 130*b* defining respective skirt surfaces 103*a*, 103*b* that generally support the piston assembly 100 during engine operation, e.g., by interfacing with surfaces of an engine bore (not shown) to stabilize the piston assembly 100 during reciprocal motion within the bore. For example, the skirt surfaces 103 may generally define a circular outer shape about at least a portion of a perimeter of the piston assembly 100. The outer shape may correspond to the engine bore surfaces, which may be generally cylindrical.

The skirt 102 may also define piston pin bosses 105. The piston pin bosses 105 may generally be formed with apertures or pin bores 109 configured to receive a piston pin (not shown) along a pin bore axis B-B. For example, a piston pin may be inserted through the pin bores 109 in the piston pin bosses 105, thereby generally securing the piston 100 to a connecting rod (not shown). Various features of the piston 100, e.g., the ring grooves 107, pin bosses 105 and/or the pin bores 109 formed therein, may be provided by being formed integrally as part of the same process used to form the skirt 102 and/or crown 104, e.g., casting, forging, or the like. Alternatively, they may be formed subsequently, e.g., by machining, punching, or other material removal processes.

In exemplary approaches where the skirt 102 and crown 104 are initially formed as separate parts and subsequently joined together, the skirt 102 and body 104 may be joined such that upper surfaces of the skirt 102 define in part a lower portion of the combustion bowl. More specifically, the crown 104 may initially be formed in a ring shape which receives the skirt 102 therein at a joint 140. As shown in FIG. 1, an exemplary joint 140*a* may be positioned along an upper surface 132 of the piston 100, or an exemplary joint 140*b* may be positioned radially inwardly along a lower portion of the combustion bowl 120. In such examples, a cover plate 170 may be provided to generally enclose a cooling gallery 160 formed within the crown 104. The cover plate 170 may be seated in a lower region of the ringland 106 along a radially outer end of the cover plate 170, and upon a circumferentially extending ledge or wall 172 along a radially inner end of the cover plate 170. Accordingly, the cooling gallery 160 is generally enclosed, apart from one or more inlets/outlets (not shown in FIG. 1) to permit intake/evacuation of oil to the gallery 160.

Figure 2A:
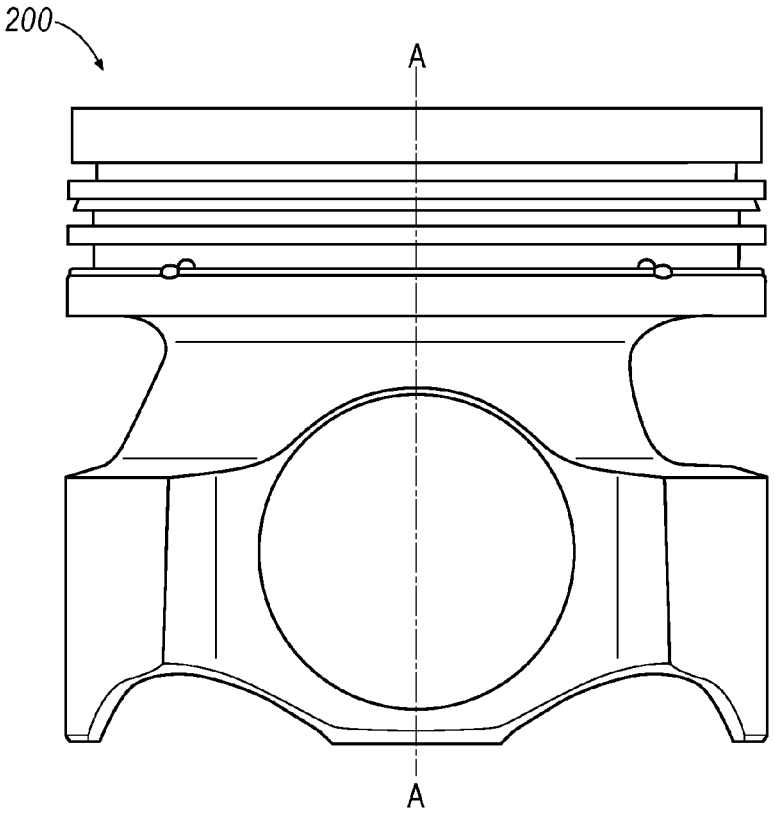
FIG. 2A is a perspective view of another exemplary piston.
Figure 2B:
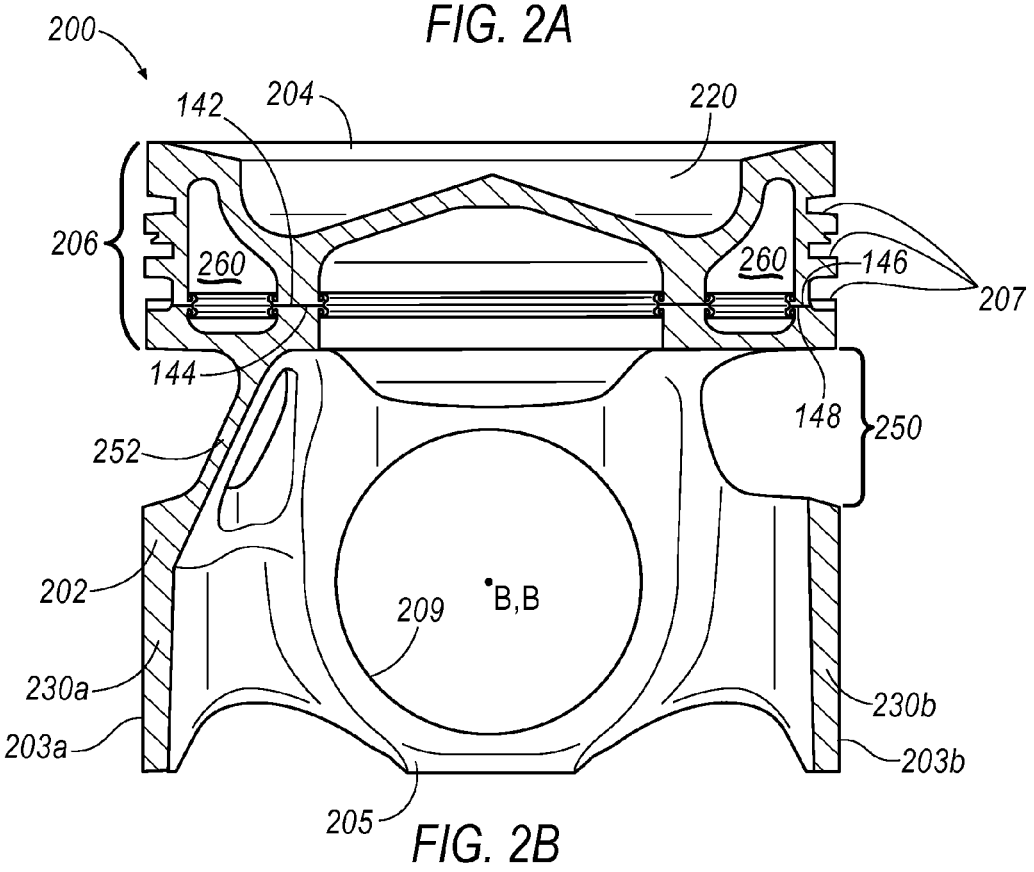
FIG. 2B is a sectional view of the exemplary piston of FIG. 2A.
Figure 2C:
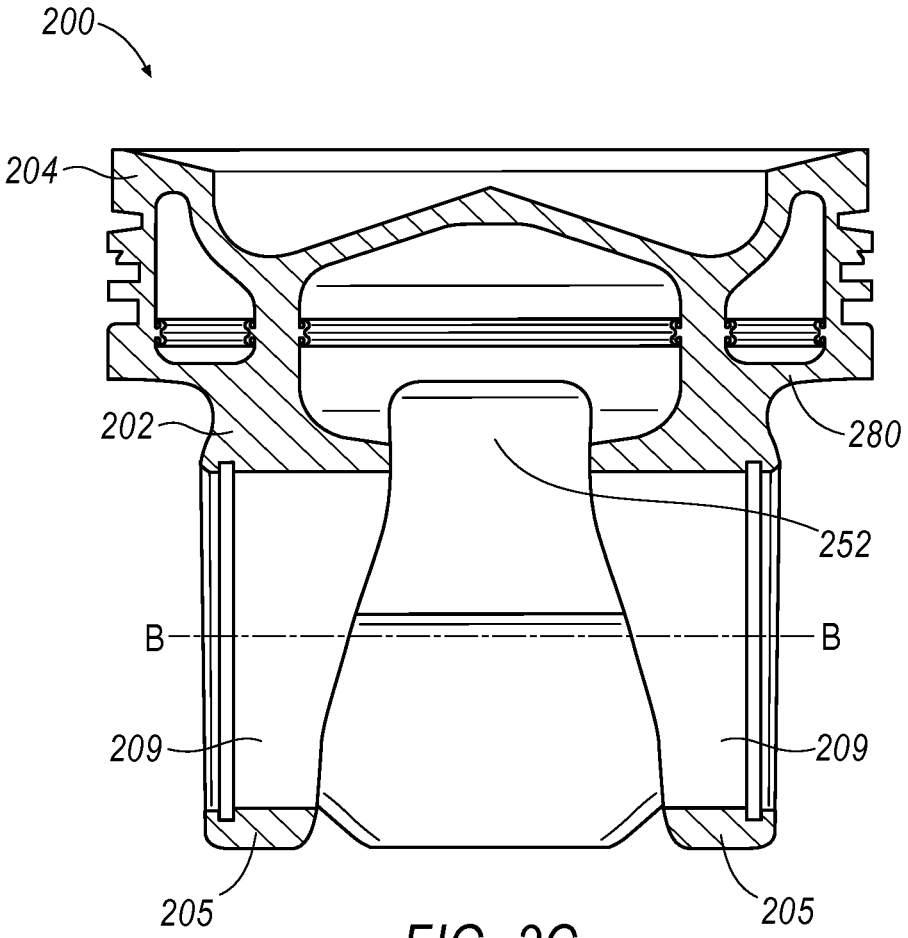
FIG. 2C is a sectional view of the exemplary piston of FIGS. 2A and 2B, with the section taken through a plane perpendicular to that in the sectional view of FIG. 2A.

In another exemplary approach shown in FIGS. 2A-2C, a piston 200 may have a crown 204 and skirt 202 that are be joined via radially spaced pairs of joining surfaces disposed entirely beneath a combustion bowl 220. The piston 200 may have a longitudinal axis A-A and a pin bore axis B-B defined by the pin bores 205. The pin bore axis B-B may extend generally perpendicular to the longitudinal axis A-A. Accordingly, the combustion bowl 220 is defined by the crown 204 alone. The crown 204 may define a radially inner joining surface 144, and a radially outer joining surface 148, each circumferentially extending about the crown 204. The skirt 202 may define corresponding radially inner and radially outer joining surfaces 142 and 146, respectively. Each of the pairs of joining surfaces may be welded, e.g., via friction welding or laser welding, or bonded, merely as examples, thereby permanently joining the crown 204 and skirt 202 together.

Accordingly, the skirts 102, 202 and crowns 104, 204 of the above exemplary pistons 100, 200 may be fixedly joined in any process that is convenient. Merely as examples, the skirt 102, 202 and crown 104, 204 may be joined in a friction welding, laser welding, bonding, or brazing process. By fixedly joining the skirt 102, 202 and crown 104, 204 the piston 100, 200 may be generally formed as a one-piece assembly.

The piston skirt 102, 202 and crown 104, 204 may be constructed from any materials that are convenient. In examples where the skirt and crown are friction or laser welded together, the materials of each may be susceptible to being friction or laser welded, respectively. In one exemplary illustration, the skirt 102, 202 and crown 104, 204 are formed of different materials. Accordingly, a material used for each component may be more closely matched with the general requirements and operating conditions relevant to each. Piston skirt 102, 202 may, merely as examples, include different mechanical properties, e.g., yield point, tensile strength or notch toughness, than the crown 104, 204. Any material or combination may be employed for the skirt 102, 202 and crown 104, 204 that is convenient. Merely as examples, the skirt 102, 202 and/or crown 104, 204 may be formed of a steel material, cast iron, aluminum material, composite, or powdered metal material. Additionally, any forming processes that are convenient may be used for the skirt 102, 202 and crown 104, 204. Merely as examples, the crown 104, 204 and/or skirt 102, 202 may be formed by forging, casting, sintering, or any other process that is convenient. Moreover, any material and/or forming combination of the crown 104, 204 and skirt 102, 202 may be employed that is convenient.

Referring again to FIG. 1, piston 100 may have skirt supports 130*a*, 130*b* defining respective skirt surfaces 103*a*, 103*b*. The skirt support 130*a* may have a different radial stiffness than the skirt support 130*b*. For example, as shown in FIG. 1, the skirt support 130*b* may define an opening 150 in an upper portion thereof, thereby reducing an overall stiffness of the skirt support 130*b*. The opening 150 may extend in a direction parallel to the pin bore axis B-B defined by the pin bores 109. By contrast, the skirt support 130*a* includes a generally continuous wall portion 152 extending from the upper portion of the skirt support 130*a* to a lower portion of the combustion bowl 120. In other examples, the skirt support 130*a* may have an opening that defines a different size or configuration compared with that of the opening 150 in skirt support 130*b*. As a result of the difference or asymmetric relationship between the opening 150 in one skirt support 130*b* and the different opening or continuous wall 152 in the other support 130*a*, the skirt support 130*b* may have a radial stiffness that is different compared with that of the skirt support 130*a*. For example, the skirt support 130*b* may have a decreased radial stiffness compared with the skirt support 130*a*, resulting from the lack of an opening or smaller opening in the skirt support 130*a* compared with the opening 150 in skirt support 130*b*.

Referring now to FIGS. 2A-2C, piston 200 may have skirt supports 230*a*, 230*b* defining respective skirt surfaces 203*a*, 203*b*. The skirt support 230*a* may have a different radial stiffness than the skirt support 230*b*. For example, the skirt support 230*b* may define an opening 250 in an upper portion thereof, thereby reducing an overall stiffness of the skirt support 230*b*. The opening 250 may extend in a direction parallel to the pin bore axis B-B defined by the pin bores 209. By contrast, the skirt support 230*a* includes a generally continuous wall portion 252 extending upwardly from the upper portion of the skirt support 230*a* toward a lower portion of the combustion bowl 220. The skirt support 230*a* may have an opening that defines a different size or configuration compared with that of the opening 250 in skirt support 230*b*. As a result of the difference or asymmetric relationship between the opening 250 in one skirt support 230*b* and the different opening or continuous wall in the other support 230*a*, the skirt support 230*b* may have a radial stiffness that is different compared with that of the skirt support 230*a*. For example, the skirt support 230*b* may have a decreased radial stiffness compared with the skirt support 230*a*, resulting from the lack of an opening or smaller opening in the skirt support 230*a* compared with the opening 250 in skirt support 230*b*.

In some exemplary illustrations, differences in radial stiffness may be provided, at least in part, by different thicknesses in skirt supports. For example, as shown in FIG. 1, the skirt support 130*b* may have a wall thickness $T_1$ that is different from a wall thickness $T_3$ of the skirt support 130*a*, thereby reducing or increasing radial stiffness of the skirt support 130*b* according to whether the wall thickness $T_1$ of the skirt support 130*b* is thinner or thicker than the wall thickness $T_3$ of the skirt support 130*a*, respectively. Additionally, as illustrated in FIG. 1 and described below, one or both skirt supports 130 may define a varying wall thickness. Merely as an example, the skirt support 130*b* may taper from an initial thickness $T_1$ along an upper end of the skirt support 130*b* to a smaller thickness $T_2$ along a lower end of the skirt support 130*b*. In one exemplary approach, the thickness tapers in a linear fashion from the thickness $T_1$ along an upper portion of the skirt support 130*b* to the thickness $T_2$ along a lower portion of the skirt support 130*b*.

As noted above, in some exemplary approaches the thrust side of pistons 100, 200, e.g., with skirt support 130*a*, 230*a*, defines a greater radial stiffness than that of the anti-thrust side of the piston, e.g., with skirt supports 130*b*, 130*b*. This may be particularly beneficial since the thrust side must typically support a larger radial load during reciprocation of the piston 100, 200 within a cylinder bore (not shown). The matching of greater radial stiffness on one side of the piston 100 or 200 with a side of the piston 100 or 200 which experiences greater load during operation may facilitate a balancing of lateral motion of the piston, thereby reducing noise/vibration/harshness of the engine during operation. Additionally, overall weight of the piston 100, 200 may be reduced by the fact that relatively less material is used on the anti-thrust side, i.e., with skirt support 130*b*, 230*b*, resulting from a decreased thickness of the skirt support 130*b*, 230*b* and/or the openings 150, 250.

The skirt supports 130 may also define a varying thickness as noted above, for example in a direction extending longitudinally with respect to the piston. More specifically, as shown in FIG. 1, skirt support 130*b* may define a wall thickness $T_1$ adjacent an upper or uppermost portion of the skirt support 130*b*. The skirt support 130*b* may define a second wall thickness $T_2$ adjacent a lower or lowermost portion of the skirt support 130*b* that is different in magnitude than the wall thickness $T_1$. In one exemplary approach, the skirt support 130*b* may narrow from an upper portion thereof to a lower portion, such that the thickness $T_1$ is greater than the thickness $T_2$. Alternatively, the thickness $T_1$ may be smaller than the thickness $T_2$.

Figure 3:
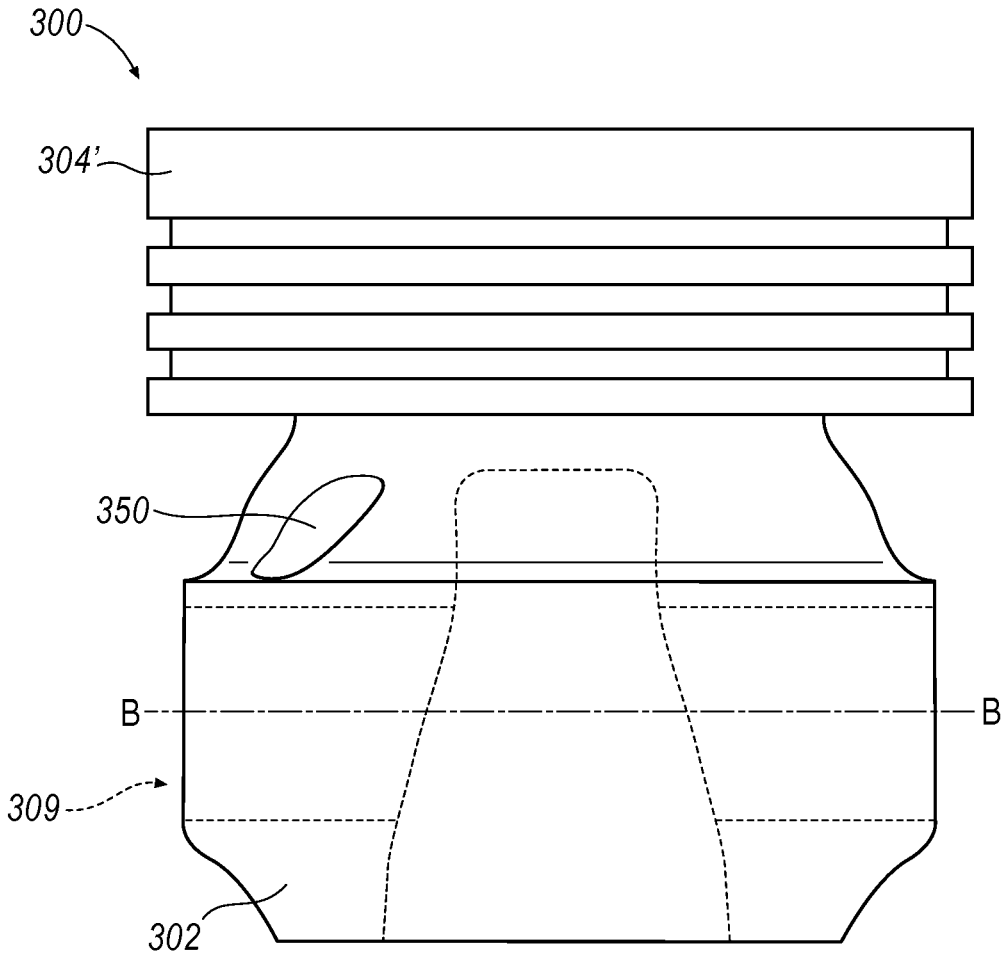
FIG. 3 is a front perspective view of a piston, according to an exemplary illustration.

Turning now to FIG. 3, another exemplary piston 300 is illustrated. As noted above, exemplary pistons may have an asymmetric configuration, e.g., where a first skirt support defines an opening while the opposite skirt support does not, or defines an opening having a different size/configuration. Additionally, further openings may be provided to allow access to a cooling gallery of the piston. In the exemplary approach illustrated in FIG. 3, a relatively small opening 350 is provided to permit access to the cooling gallery within the crown 304 by oil jets from the crankcase (not shown). Moreover, multiple relatively small openings 350 may be provided, e.g., such that one is used as an oil inlet for the cooling gallery, while another is used as an outlet for oil to return to the crankcase. The opening 350 may be provided in addition to other openings (not shown in FIG. 3). The opening(s) may collectively establish a difference in radial stiffness between opposing sides of the piston 300.

Figure 4:
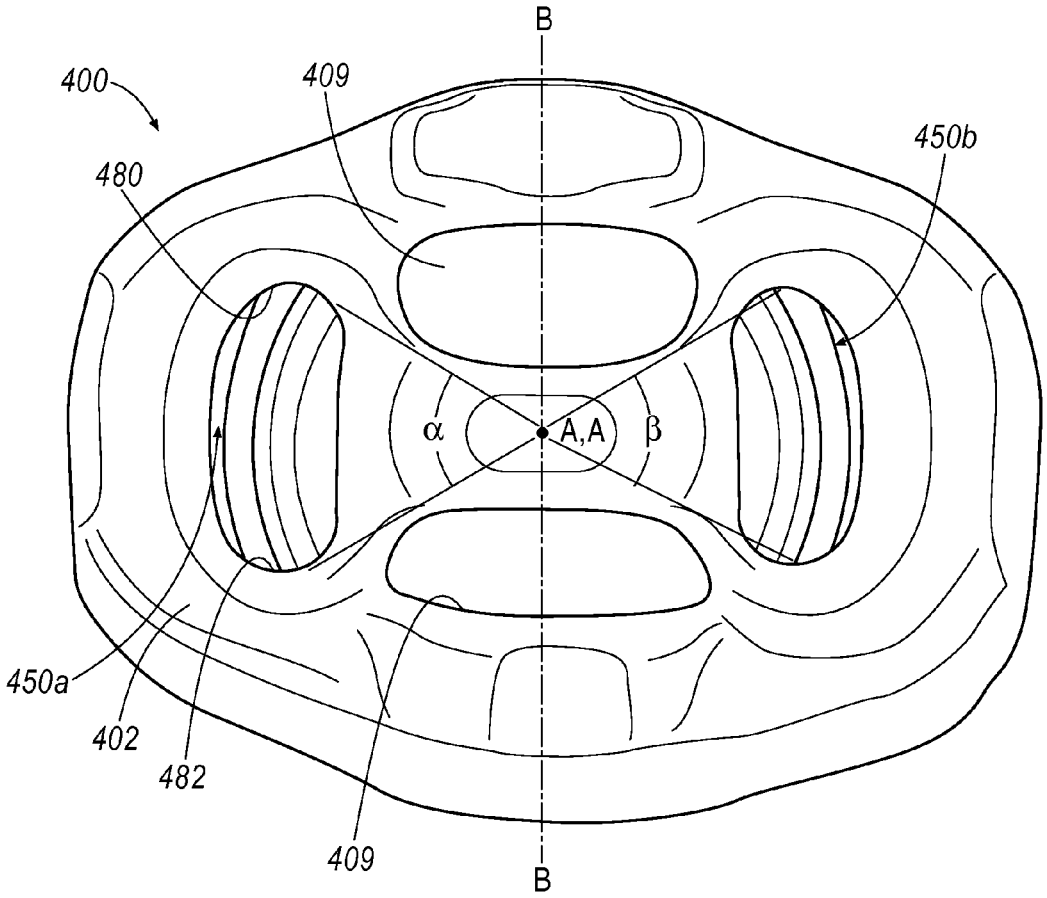
FIG. 4 is a bottom perspective view of a piston, according to an exemplary illustration.

Turning now to FIG. 4, another exemplary piston 400 is illustrated. In this exemplary approach, an opening 450*a* is provided on one side of the piston 400, while a second opening 450*b* is provided on an opposite side. The openings 450*a*, 450*b* may extend laterally across the piston 400, i.e., in a direction parallel to a longitudinal axis B-B of the piston pin bores 409. The opening 450*a* may define a larger lateral extent than the opening 450*b*, thereby resulting in a lower radial stiffness of the piston on that side compared with that defining the opening 450*a*.

Exemplary openings 150, 250, 350, and/or 450 may have any size that is convenient to establish a desired difference in radial stiffness between opposing sides of a piston. Merely as examples, as best seen in FIG. 4 an opening 450*a* may be sized such that an acute angle $\alpha$ is formed by the lateral ends 480, 482 of the opening 450*a* with respect to a longitudinal axis A-A of the piston 400. By contrast, a comparatively smaller angle $\beta$ is formed by the opening 450*b* as a result of the smaller lateral extent of the opening 450*b*.

Exemplary pistons 100 may be employed in small and large bore diameter applications, generally without limitation. Additionally, exemplary pistons 100 may be used in any fuel application that is convenient, including diesel, natural gas, gasoline, ethanol, and oil fuel applications typical of heavy duty marine applications.

Figure 5:
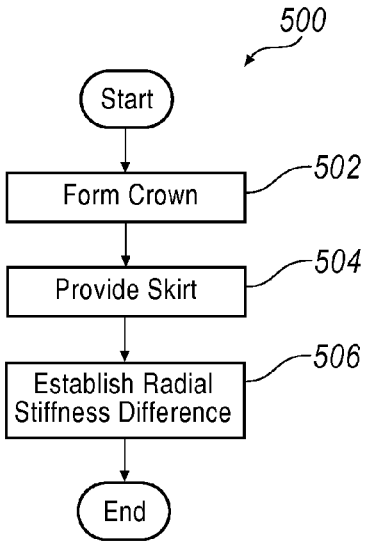
FIG. 5 illustrates a process flow diagram for an exemplary method.

Turning now to FIG. 5, an exemplary process 500 for making a piston is illustrated. Process 500 may begin at block 502, where a crown is formed. For example, as noted above an exemplary piston crown 104, 204 may be formed of any material that is convenient, in any forming process that is convenient.

Proceeding to block 504, a skirt may be provided. For example, a skirt 102, 202 may be provided. The skirt 102, 202 may be joined with the crown 104, 204 in any manner that is convenient, e.g., via welding or bonding, merely as examples. Alternatively, the skirt 102, 202 may be formed of a single monolithic piece with the crown 104, 204, e.g., via a forging operation. Process 500 may then proceed to block 506.

At block 506, a difference in radial stiffness may be established between opposing sides of the piston. In some exemplary illustrations, an opening 150, 250, 350, and/or 450 may be provided which establishes an asymmetric relationship between opposing sides of a piston, e.g., pistons 100, 200, 300, or 400. The lack of an opening on one side or different size/configuration in openings on each side of a piston may establish a difference in radial stiffness between the sides of the pistons 100, 200, 300, 400. Exemplary features creating an asymmetric relationship between opposing sides of a piston, e.g., openings, differences in material thickness, or the like, may be formed integrally or as part of a forming process used to form the piston or components thereof, e.g., by forging, casting, or sintering. Alternatively, opening, differences in material thickness, or the like may be formed via machining or other material removal process after the piston or component thereof is initially formed.

With regard to the processes, systems, methods, heuristics, etc. described herein, it should be understood that, although the steps of such processes, etc. have been described as occurring according to a certain ordered sequence, such processes could be practiced with the described steps performed in an order other than the order described herein. It further should be understood that certain steps could be performed simultaneously, that other steps could be added, or that certain steps described herein could be omitted. In other words, the descriptions of processes herein are provided for the purpose of illustrating certain embodiments, and should in no way be construed so as to limit the claimed invention.

Accordingly, it is to be understood that the above description is intended to be illustrative and not restrictive. Many embodiments and applications other than the examples provided would be upon reading the above description. The scope of the invention should be determined, not with reference to the above description, but should instead be determined with reference to the appended claims, along with the full scope of equivalents to which such claims are entitled. It is anticipated and intended that future developments will occur in the arts discussed herein, and that the disclosed systems and methods will be incorporated into such future embodiments. In sum, it should be understood that the invention is capable of modification and variation and is limited only by the following claims.

All terms used in the claims are intended to be given their broadest reasonable constructions and their ordinary meanings as understood by those skilled in the art unless an explicit indication to the contrary in made herein. In particular, use of the singular articles such as "a," "the," "said," etc. should be read to recite one or more of the indicated elements unless a claim recites an explicit limitation to the contrary.

What is claimed is:

1. A piston, comprising:

a crown defining a combustion bowl and a ring land extending circumferentially around the combustion bowl, the crown defining at least in part a cooling gallery extending circumferentially about the piston; and a skirt supporting the crown, the skirt having a first side and a second side, and including a pair of pin bosses, the pin bosses each defining a pin bore that receives a piston pin along a pin bore axis extending between the pin bosses, the skirt including the first side and the second side defining surfaces configured to slide along a cylinder bore surface, wherein the first side defines a first opening, and the second side defines a second opening, the second opening extending parallel to the pin bore axis such that the first side defines a first radial stiffness that is greater less than a second radial stiffness of the second side, and the second side of the skirt defines the second opening that is different in configuration from the first opening;

wherein the second side includes the second opening that is larger than the first opening, and the radial stiffness of the first side is at least twice the radial stiffness of the second side.

2. The piston of claim 1, wherein the first opening extends through an upper surface of a skirt panel.

3. The piston of claim 1, wherein opposite lateral ends of the first opening define an acute angle with a longitudinal piston axis.

4. The piston of claim 1, wherein at least one of the skirt supports defines a varying thickness running along the associated skirt surface, wherein the varying thickness decreases in magnitude from an upper portion of the skirt support to a lower portion of the skirt support.

5. The piston of claim 1, wherein at least one of the crown and the skirt is forged.

6. The piston of claim 5, wherein the crown and the skirt are forged from a single monolithic piece.

7. The piston of claim 1, wherein at least one of the crown and the skirt is cast.

8. The piston of claim 1, wherein the crown and skirt are one of welded and bonded together, wherein the crown and skirt each define a radially inner annular joining surface and a radially outer annular joining surface, and the crown and skirt are joined together along the radially inner and radially outer annular joining surfaces.

9. The piston of claim 1, wherein the first skirt support, on the first side, includes the first opening between the upper portion of the first skirt support and a lower portion of the combustion bowl, resulting in an asymmetric relationship between the first radial stiffness and the second radial stiffness.

10. The piston of claim 1, wherein the first side is a thrust side of the piston, and the second side is an anti-thrust side of the piston.

11. A method of making a piston, comprising:

forming a crown defining a combustion bowl and a ring land extending circumferentially around the combustion bowl; and providing a skirt supporting the crown, the skirt having a first side and a second side, the skirt including a pair of pin bosses, the pin bosses each defining a pin bore that receives a piston pin, the skirt including two opposing skirt supports defining surfaces configured to slide along a cylinder bore surface; and establishing a first one of the skirt supports, corresponding to the first side, as defining a first opening such that a first radial stiffness of the first skirt support is greater than a second radial stiffness of the second one of the skirt supports, and the second side of the skirt defines a second opening, extending parallel to the pin bore axis, the second opening being different in configuration from the first opening;

wherein the second support includes the second opening that is larger than the first opening, and the radial stiffness of the first one of the skirt supports is at least twice the radial stiffness of the second one of the skirt supports.

12. The method of claim 11, further comprising establishing the first-opening as extending through an upper surface of a skirt panel.

13. The method of claim 11, further comprising establishing opposite lateral ends of the first opening as defining an acute angle with a longitudinal piston axis.

14. The method of claim 11, wherein the crown and the skirt are forged from a single monolithic piece.

15. The method of claim 11, wherein the crown and the skirt each define a radially inner joining surface and a radially outer annular joining surface, and the crown and the skirt are joined together along the radially inner and radially outer annular joining surfaces.

16. The method of claim 11, further comprising establishing one of the first and the second skirt supports as defining at least the second opening configured to permit fluid communication between the cooling gallery and an engine crankcase.

17. The method of claim 11, wherein the first skirt support, on the first side, includes the first opening between the upper portion of the first skirt support and a lower portion of the combustion bowl, resulting in an asymmetric relationship between the first radial stiffness and the second radial stiffness.

18. The method of claim 11, wherein the first side is a thrust side of the piston, and the second side is an anti-thrust side of the piston.

* * * * *